US005934233A

United States Patent [19]

Auchter et al.

[11] Patent Number: 5,934,233

[45] Date of Patent: Aug. 10, 1999

[54] APPARATUS FOR ADJUSTING THE BASIC POSITION OF A CAMSHAFT ADJUSTMENT UNIT OF AN INTERNAL COMBUSTION ENGINE

[75] Inventors: Jochen Auchter, Aurachtal; Andreas Strauss, Herzogenaurach; Eduard Golovatai-Schmidt, Röttenbach, all of Germany

[73] Assignee: INA Wälzlager Schaeffler OHG, Herzogenaurach, Germany

[21] Appl. No.: 09/032,854

[22] Filed: Mar. 2, 1998

[30] Foreign Application Priority Data

Mar. 10, 1997 [DE] Germany ..... 197 09 656

[51] Int. Cl.[6] ..... F01L 1/344

[52] U.S. Cl. ..... 123/90.17; 123/90.31; 74/568 R; 464/2; 464/160

[58] Field of Search ..... 123/90.15, 90.17, 123/90.31; 74/567, 568 R; 464/1, 2, 160

[56] References Cited

U.S. PATENT DOCUMENTS 5,355,850 10/1994 Gullberg ..... 123/90.17
5,447,126 9/1995 Kondoh et al. ..... 123/90.17
5,738,055 4/1998 Allen ..... 123/90.17

FOREIGN PATENT DOCUMENTS 33 16 162 A 1 11/1983 Germany .
195 25 837 A1 1/1997 Germany .

*Primary Examiner*—Weilun Lo
*Attorney, Agent, or Firm*—Henry M. Feiereisen

[57] ABSTRACT

Apparatus for adjusting the basic position of a camshaft adjustment unit of an internal combustion engine, includes a first structure secured to a crankshaft and a second structure secured to a camshaft and having a camshaft-distant end surface formed with one or more form-fitting and/or force-locking force-transmitting elements. A piston reciprocates between two end positions and is so operatively connected with the first and second structures that a displacement of the piston results in a rotation of the first and second structures relative to one another. In order to position the adjustment unit in the basic position and to prevent the adjustment unit from executing a rotation relative to the camshaft after occupying the basic position, a tool is attachable to the adjustment unit which tool is formed with counterelements which complement the force-transmitting elements to effect a non-rotatable connection between the tool and the adjustment unit.

6 Claims, 2 Drawing Sheets

APPARATUS FOR ADJUSTING THE BASIC POSITION OF A CAMSHAFT ADJUSTMENT UNIT OF AN INTERNAL COMBUSTION ENGINE

BACKGROUND OF THE INVENTION

The present invention relates to an apparatus for adjusting a basic position of a camshaft adjustment unit for infinitely varying rotational relations between a camshaft and a crankshaft of an internal combustion engine.

Typically, the camshaft adjusting mechanism is attached at one end surface of the camshaft (or a shaft to be adjusted) and includes a crankshaft-fixed structure such as timing pulley which is driven by the crankshaft via a timing belt or chain, a camshaft-fixed structure such as a drive wheel, and an adjusting piston which reciprocates between two end positions for rotating the crankshaft-fixed structure and the camshaft-fixed structure relative to one another. Such adjustment units are known in various designs. The installation of the adjustment unit to the camshaft of an internal combustion engine or to an intermediate shaft positioned between the crankshaft and two camshafts is normally attained by fixedly mounting the camshafts in place and randomly installing the adjustment unit in a centering receptacle of the camshaft. Then, the adjustment unit is screwed with a central screw fastener to the camshaft to such an extent that a rotation of the adjustment unit relative to the camshaft (or intermediate shaft) is still possible. The timing belt or chain is then laid around the drive wheel of the camshaft and tightened. As a result of the still possible relative rotation between the adjustment unit and the camshaft, the adjustment unit can then be positioned to occupy its basic disposition, i.e. can be so turned that the adjusting piston occupies an end position, called retard position. Subsequently, the central screw fastener is further tightened to fixedly secure the adjustment unit onto the camshaft, and the timing belt or chain is tensioned to exhibit the necessary operational tension.

Practice has shown, however, that during tightening of the adjustment unit upon the camshaft and/or during tensioning of the timing belt, the adjusting piston shifts from its basic position after assembly as a result of the torque being transmitted during installation.

Although an incorporated associated electronic engine control for the adjustment unit is capable to recognize the angular relation between the crankshaft and the camshaft, the basic position of the adjusting piston is still set as fixed parameter. Thus, a shift of the adjusting piston from the basic position has the consequence that after assembly, the existing actual state does no longer correspond to the parameters of the control such as stroke, phase position, opening angle of the valves. This may lead to undesired shifts of the valve timing and in a worst case scenario to a collision of the valve with the piston.

SUMMARY OF THE INVENTION

It is thus an object of the present invention to provide an improved adjustment unit, obviating the afore-stated drawbacks.

In particular, it is an object of the present invention to provide an improved adjustment unit which can be so installed as to ensure a simple and cost-efficient adjustment of the adjusting piston to occupy a precise basic position.

These objects, and others which will become apparent hereinafter, are attained in accordance with the present invention by providing a camshaft-fixed structure which has a camshaft-distant end surface formed with one or more form-fitting and/or force-locking force-transmitting elements which are acted upon during the adjusting operation by a tool having means complementary to the force-transmitting elements for turning the camshaft-fixed structure relative to the crankshaft-fixed structure.

Unlike conventional constructions, the adjustment unit according to the present invention is so configured that through application of a simple tool the torque applied during tightening of the adjustment unit upon the camshaft and tensioning of the timing belt or chain is opposed by a counterforce that acts upon the camshaft-fixed structure so that the adjusting piston retains its basic position until conclusion of the installation process. Thus, faulty functions of the adjustment unit during operation of the internal combustion engine and thus ensuing damage of the valve or pistons can now reliably be eliminated.

According to another feature of the present invention, the end surface of the camshaft-fixed structure is formed with preferably two axial blind bores to form the force-transmitting elements, with the blind bores being arranged coaxially and offset to one another by 180° for attachment of complementary pins of a ring spanner that forms the tool.

Alternatively, the end surface of the camshaft-fixed structure may also be formed with preferably two pins to form the force-transmitting element, with the pins being arranged coaxially and offset to one another by 180° for attachment of complementary bores of a ring spanner that forms the tool.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
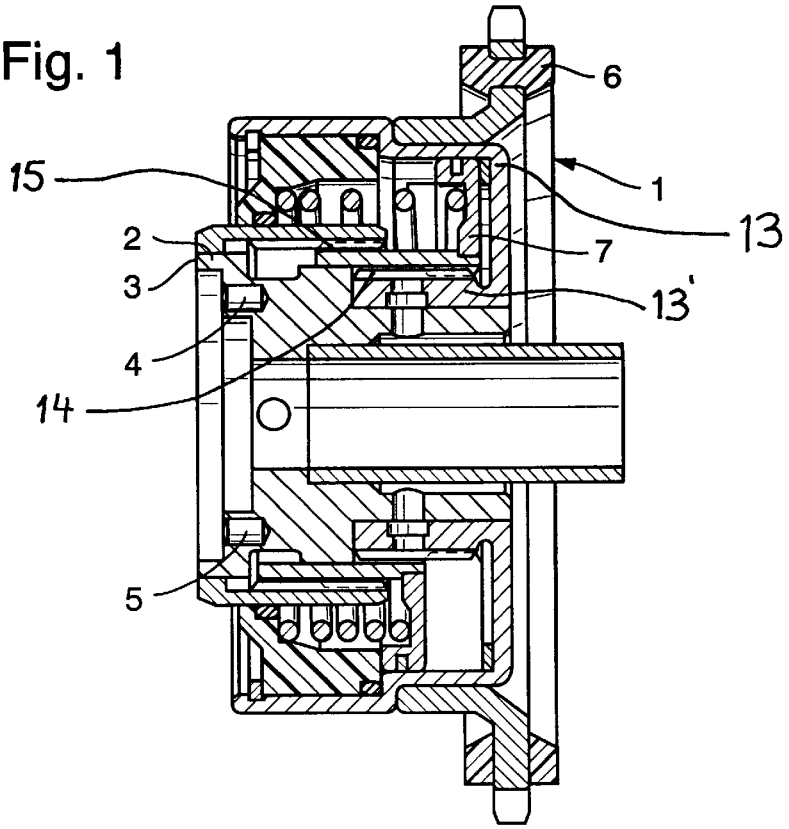
FIG. 1 is a schematic longitudinal section of one embodiment of a hydraulic camshaft adjustment unit according to the present invention.

Throughout all the Figures, same or corresponding elements are generally indicated by same reference numerals.

Turning now to the drawing, and in particular to FIG. 1, there is shown a schematic longitudinal section of one embodiment of a hydraulic camshaft adjustment unit according to the present invention, generally designated by reference numeral 1 for attachment to a camshaft 11 (FIG. 3) and allowing infinitely variations of a rotational relation between the camshaft 11 and a crankshaft (not shown) of an internal combustion engine. In a manner known per se, the camshaft 11 is rotatably supported in a cylinder head (not shown), with the adjustment unit 1 being arranged in driving relationship between the camshaft 11 and a structure 6, such as a timing pulley, which is in mesh with a timing belt (not shown) to transmit the driving force of the engine via the crankshaft to the structure 6 and thus to the camshaft 11 in order to operate gas exchange valves.

The structure 6 is connected radially inwardly to a driving element 13 which is formed with an axial sleeve 13'. Outer gear teeth 14 are provided on the axial sleeve 13' and capable of meshing complementary inner gear teeth of an adjusting piston 7 which is axially displaceable by a hydraulic medium between two end positions. The adjusting piston 7 is formed with outer gear teeth 15 which are adapted for engagement with radially inner gear teeth of a structure or driven element 2 which is so secured by a screw fastener 12 (FIG. 3) to the camshaft 11 as to be prevented from rotation relative to the camshaft 11. Upon supply of hydraulic medium and axial displacement of the adjusting piston 7, the structure 6 is rotated relative to the camshaft 11 via meshing gear teeth 14, 15.

It will be understood by persons skilled in the art that the principles described in the foregoing and following description with respect to a camshaft are generally applicable to any types of shafts to be adjusted, such as e.g. an intermediate shaft positioned between the crankshaft and two camshafts. For sake of simplicity, the following description refers to a camshaft by way of example only.

As shown in FIG. 1, the camshaft-fixed structure 2 is formed at the camshaft-distal end surface 3 with one or more form-fitting and/or force locking force transmitting elements 4, 5 for attachment of complementary counterelements 9, 10 formed on an auxiliary tool (FIG. 3) to thereby effect a rotation of the camshaft-fixed structure 2 relative to the crankshaft-fixed structure 6. In the embodiment of FIG. 1, the force-transmitting elements 4, 5 are formed by two blind bores which are received in the end surface 3 of the camshaft-fixed structure 2. The blind bores 4, 5 extend parallel to the longitudinal axis L of the adjustment unit 1 and are offset to one another by 180°. The tool 8 for attachment to the camshaft-fixed structure 2 is formed as ring spanner with the counterelements 9, 10 in the form of projections or pins which are insertable in the blind bores 4, 5 to transmit a torque onto the camshaft-fixed structure 2 of the adjustment unit, as will be described in more detail with reference to FIG. 3.

Figure 2:
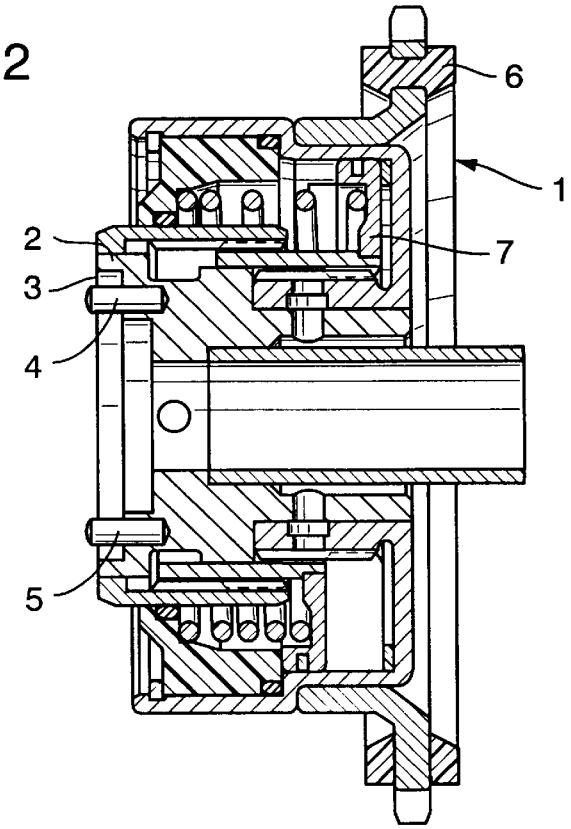
FIG. 2 is a schematic longitudinal section of another embodiment of a hydraulic camshaft adjustment unit according to the present invention.

A variation of the hydraulic camshaft adjustment unit 1 according to the present invention is shown in FIG. 2, in which the end surface 3 of the camshaft-fixed structure 2 is provided with two pins 4, 5 to form the force-transmitting elements. The pins 4, 5 extend parallel to the longitudinal axis L of the adjustment unit 1 and are offset to one another by 180°. The complementary auxiliary tool 8 is formed as ring spanner with respective bores as counterelements 9, 10 so that attachment and turning of the ring spanner 8 transmits a torque onto the camshaft-fixed structure 2 of the adjustment unit 1.

Figure 3:
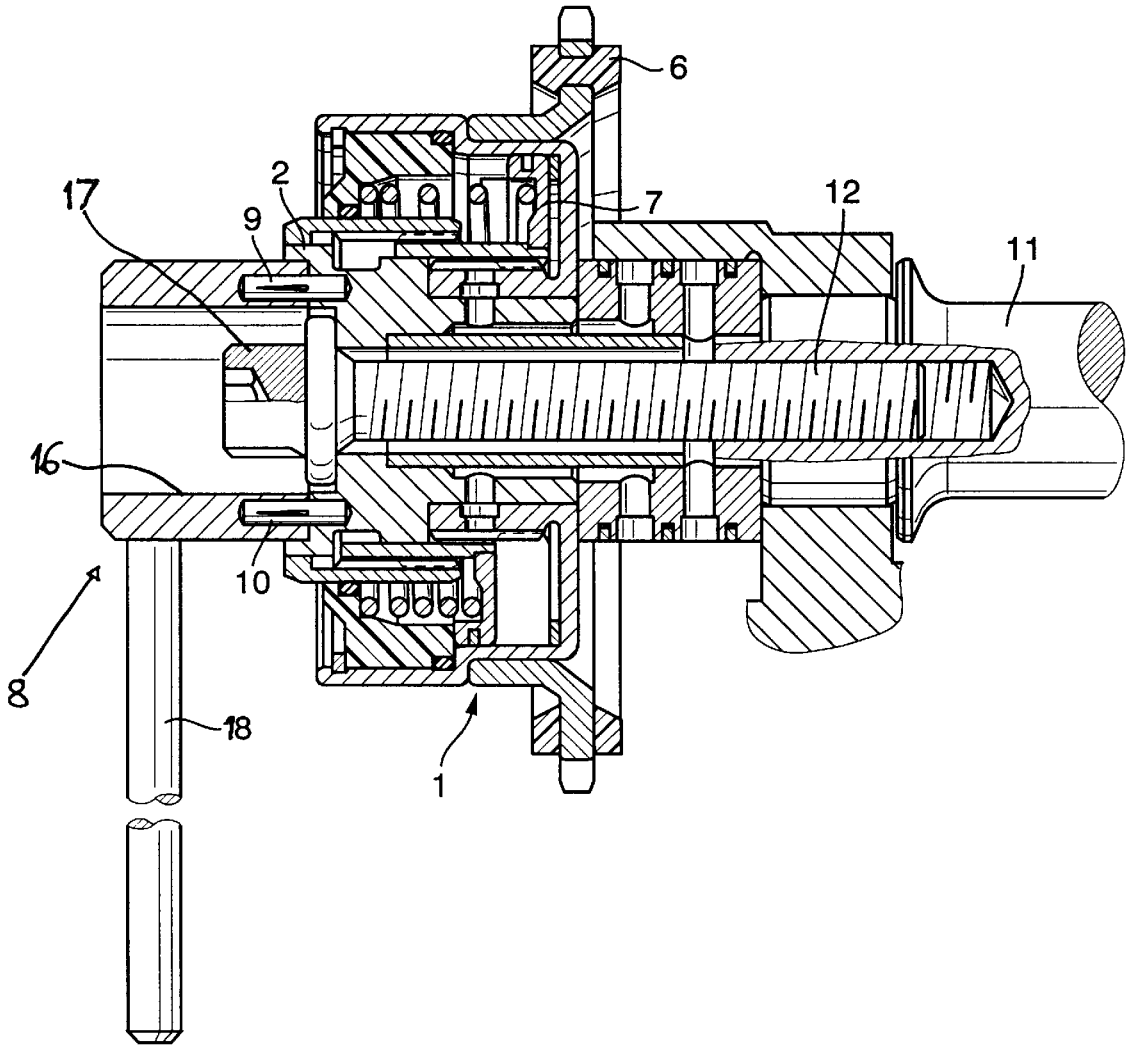
FIG. 3 is a schematic longitudinal section of the hydraulic camshaft adjustment unit of FIG. 1, attached to a camshaft and acted upon by an auxiliary tool.

Turning now to FIG. 3, there is shown a longitudinal section of the hydraulic camshaft adjustment unit 1 of FIG. 1, attached to the camshaft 11 and acted upon by the ring spanner 8 which has a head portion 16 enclosing the sleeve-like screw head 17 of the central screw fastener 12. The head portion 16 is formed at its screw-facing end surface with the counterelements 9, 10 in the form of pins. Secured at a right angle to the perimeter of the head portion 16 is a turning handle 18 for applying the torque upon the camshaft-fixed structure 2 of the adjustment unit 1.

It will be understood by persons skilled in the art that the present invention should not be limited to a particular type of camshaft adjustment unit. Rather, the principles of the present invention are applicable to all known types of camshaft adjustment units, such as electric or hydraulic adjustment unit as well as those of the rotor shaft type or those operating with axially displaceable pistons with double helical toothing. Further, it is certainly within the scope of the present invention to provide axial blind bores and complementary pins of a number other than two, as described here, on the free end surface of the camshaft adjustment unit in symmetric or also asymmetric offset disposition. Moreover, the form-fitting and/or force-locking force transmitting elements at the free end surface of the camshaft adjustment unit may also be formed by tooth-like coaxial elevations or depressions for interaction with respective counterelements on the auxiliary tool to effect a connection that is prevented from rotating relative to one another.

Installation and attachment of an adjustment unit 1 according to the present invention to the camshaft 11 of an internal combustion engine is carried out as follows: First, the camshaft 11 is securely fixed in place and the camshaft adjusting mechanism 1 is attached to the camshaft in randomly centered disposition with respect to the camshaft 11. Subsequently, the camshaft adjustment unit 1 is so secured onto the camshaft 11 by the screw fastener 12 that a relative rotation of the adjustment unit 1 with respect to the camshaft 11 is still possible. The timing belt is placed over the timing pulley of the crankshaft-fixed structure 6 and pre-tensioned. Thereafter, the tool 8 with its counterelements 9, 10 is inserted into the force-transmitting elements 4, 5 of the camshaft-fixed structure 2 and so rotated that the adjusting piston 7 occupies an end position in accordance with the basic position of the adjusting piston 7. While the auxiliary tool 8 is continuously held in place, the screw fastener 12, which is accessible from outside through the head portion 16 of the tool 8, is tightened further to securely fix the adjustment unit 1 to the camshaft 11, and the timing belt is tensioned to a required operational tension. As the auxiliary tool 8 is held is place during tightening of the screw fastener 12 and during tensioning of the timing belt, no torque is transmitted onto the adjusting unit 1 so that the adjusting piston 7 securely retains its set basic position.

While the invention has been illustrated and described as embodied in an apparatus for adjusting the basic position of a camshaft adjustment unit of an internal combustion engine, it is not intended to be limited to the details shown since various modifications and structural changes may be made without departing in any way from the spirit of the present invention.

What is claimed as new and desired to be protected by Letters Patent is set forth in the appended claims:

What is claimed is:

1. Apparatus for adjusting a rotational relation between a camshaft and a crankshaft of an internal combustion engine, comprising:

a first structure secured to a crankshaft;

a second structure secured to a camshaft;

a piston reciprocating between two end positions and so operatively connected with the first and second structures that a displacement of the piston results in a rotation of the first and second structures relative to one another; and an tool for temporary attachment to the second structure, wherein the tool and the second structure are formed with interacting complementing force-transmitting means in opposite disposition so that an attachment of the tool to the second structure allows a rotation of the second structure relative to the first structure to move the piston to an end position representing a basic position by turning the tool, and allows a fixed securement of the second structure to the camshaft without transmission of a torque onto the first structure when holding the tool in place.

2. The apparatus of claim 1 wherein the second structure has a camshaft-distant end surface, said force transmitting means being formed by at least one bore provided in the end surface of the second structure and a pin formed on the tool and complementing the at least one bore.

3. The apparatus of claim 1 wherein the second structure has a camshaft-distant end surface, said force transmitting means being formed by at least one pin projecting from the end surface of the second structure and a bore formed in the tool and complementing the pin.

4. In combination:

an adjustment unit for attachment to an end surface of a shaft and including a first structure secured to a crankshaft via a power transmission member, a second structure secured to the shaft, and a piston reciprocating between two end positions and so operatively connected with the first and second structures that a displacement of the piston results in a rotation of the first and second structures relative to one another, and an auxiliary tool for temporary attachment to the second structure, wherein the tool and the second structure are formed with interacting complementing force-transmitting means in opposite disposition so that an attachment of the tool to the second structure allows a rotation of the second structure relative to the first structure to move the piston to an end position representing a basic position by turning the tool, and allows a fixed securement of the second structure to the camshaft without transmission of a torque onto the first structure when holding the tool in position.

5. The apparatus of claim 4 wherein the second structure has a camshaft-distant end surface, said force transmitting means being formed by at least one bore provided in the end surface of the second structure and a pin formed on the tool and complementing the blind bore.

6. The apparatus of claim 4 wherein the second structure has a camshaft-distant end surface, said force transmitting means being formed by at least one pin projecting from the end surface of the second structure and a bore formed in the tool and complementing the pin.

* * * * *